United States Patent [19]

Kasai

[11] Patent Number: 4,815,175

[45] Date of Patent: Mar. 28, 1989

[54] STRAP FASTENER

[75] Inventor: Kazumi Kasai, Namerikawa, Japan

[73] Assignee: Yoshida Kogyo K. K., Tokyo, Japan

[21] Appl. No.: 67,738

[22] Filed: Jun. 26, 1987

[30] Foreign Application Priority Data

Jun. 26, 1986 [JP] Japan ..... 61-98134[U]

[51] Int. Cl.[4] ..... A44B 11/12

[52] U.S. Cl. ..... 24/193; 24/311; 24/543

[58] Field of Search ..... 24/193, 170, 188, 453, 24/68 C, 69 ST, 71 R, 71 ST, 311–313, 316, 323, 327, 182, 543, 544, 171, 200

[56] References Cited

U.S. PATENT DOCUMENTS

| | | | |
|---|---|---|---|
| 804,397 | 11/1905 | Grushus | 24/170 X |
| 1,311,120 | 7/1919 | Grindeland | 24/170 |
| 3,886,632 | 6/1975 | Bako . | |
| 4,220,301 | 9/1980 | Jacobs | 24/543 X |
| 4,484,397 | 11/1984 | Appelt et al. | 24/170 X |
| 4,656,697 | 4/1987 | Naslund | 24/543 X |

FOREIGN PATENT DOCUMENTS

| | | | |
|---|---|---|---|
| 2524269 | 12/1976 | Fed. Rep. of Germany | 24/543 |
| 1358218 | 3/1964 | France . | |
| 2522255 | 9/1983 | France | 24/311 |
| 1269858 | 4/1972 | United Kingdom . | |
| 2094613 | 9/1982 | United Kingdom | 24/216 |
| 2168104 | 6/1986 | United Kingdom . | |

*Primary Examiner*—Francis K. Zugel
*Assistant Examiner*—Laurie K. Cranmer
*Attorney, Agent, or Firm*—Hill, Van Santen, Steadman & Simpson

[57] ABSTRACT

A strap fastener for releasably connecting a belt to the body of a bag comprises a base plate adapted to be mounted on the body of the bag, and a cover plate pivotably connected to the base plate and releasably lockable on the base plate. The cover plate has at least one slot for the passage therethrough of the belt and receptive of a presser projection of the base plate. When the cover plate is locked on the base plate, the presser projection is received in the slot and urges the belt against a portion of the cover plate defining the slot to retain the belt on the strap fastener.

15 Claims, 4 Drawing Sheets

STRAP FASTENER

BACKGROUND OF THE INVENTION

1. Field of the Invention

The present invention relates to a strap fastener for use on shoulder bags, rucksacks, school knapsacks or other . bags for connecting the end of a belt or strap to the body of a bag.

2. Prior Art

In the manufacture of bags such as shoulder bags, it is customary to connect a belt or strap B by sewing to the body of a bag 1 together with a tab 2 of leather or thick fabric overlying an end of the belt B, as shown in FIG. 8. According to another conventional practice, the belt end is rivetted to or looped on the bag body. These conventional connections are substantially permanent and hence the belt thus connected cannot easily be detached from the bag body. Such substantially permanent connections are disadvantageous in that once a belt is broken, the replacement of the broken belt involves a tedious and time-consuming operation and hence incurs great expense. Owing to this difficulty, the bag is sometimes left aside without repair.

SUMMARY OF THE INVENTION

With the foregoing problems in view, it is an object of the present invention to provide a strap fastener for releasably connecting the end of a belt or strap to the body of a bag in firmly gripped condition.

Another object of the present invention is to provide a strap fastener having structural features which enable easy adjustment of the effective length of a belt or strap on a bag.

According to the present invention, there is provided a strap fastener for connecting a belt to the body of a bag, which comprises: a base plate adapted to be mounted on the body of the bag, the base plate including a locking nose at one of its opposite ends, and a presser projection intermediately between the opposite ends; and a cover plate pivotably connected at one of its opposite ends to the other end of the base plate, the cover plate having at the other end thereof a locking projection lockingly engageable with the locking nose to interlock the cover plate and the base plate, and at least one slot for the passage therethrough of the belt and receptive of the presser projection, when the cover plate is locked on the base plate, the presser projection being received in the slot and urging the belt against a portion of the cover plate defining the slot to grip the belt therebetween.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

As shown in FIGS. 1 through 4, a strap fastener 10 embodying the present invention generally comprises a base plate 11 adapted to be mounted on the body C of a bag, and a cover plate 12 pivotably connected to a lower end of the base plate 11. The base plate 11 and the cover plate 12 are injection-molded of synthetic resin in assembled condition.

Figure 1:
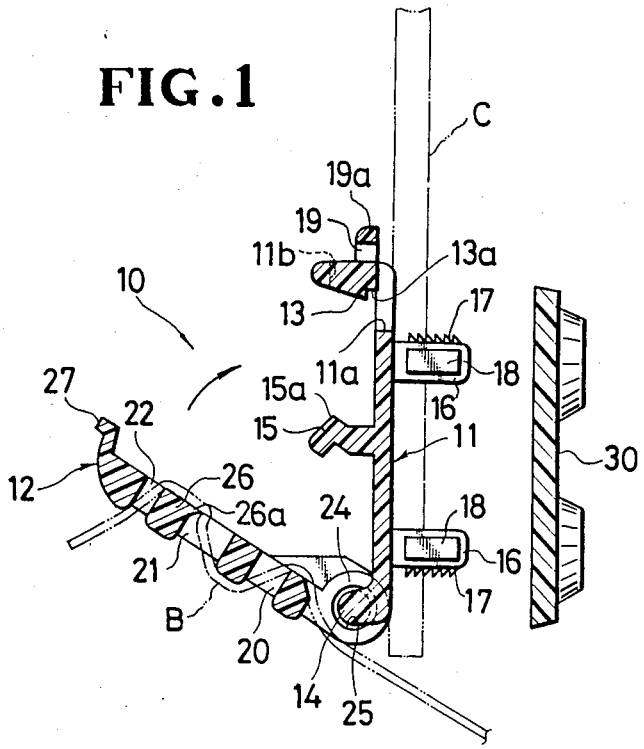
FIG. 1 is a cross-sectional view of a strap fastener embodying the present invention.
Figure 2:
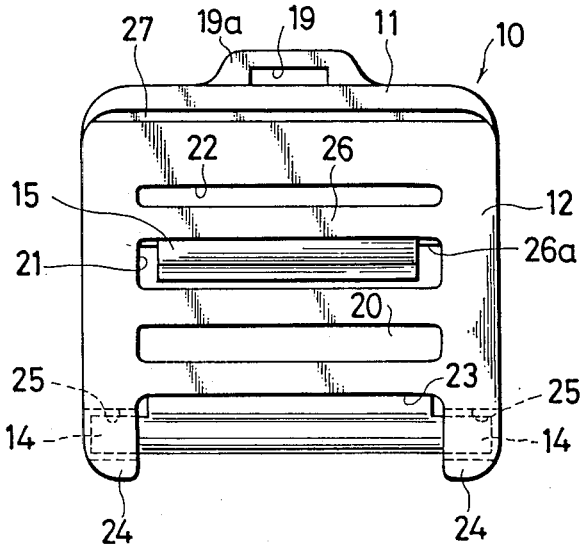
FIG. 2 is a front elevational view of the strap fastener shown in FIG. 1.
Figure 3:
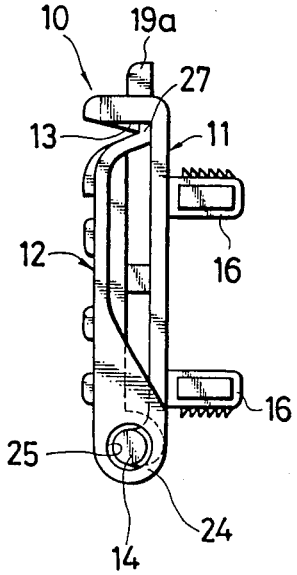
FIG. 3 is a right side view of FIG. 2.
Figure 4:
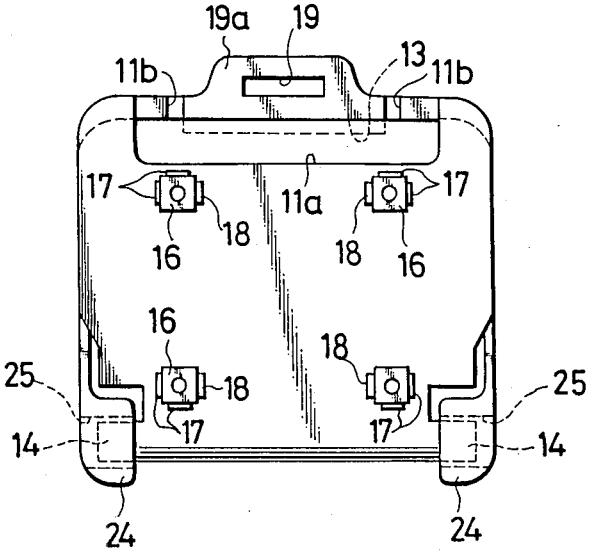
FIG. 4 is a rear view of FIG. 2.

The base plate 11 is of a generally rectangular shape and includes a hook-shaped locking projection or nose 13 extending along an upper edge of the base plate 11 and facing downwardly in FIG. 1, and a pair of coaxial shafts 14 projecting laterally outwardly from the lower end of the base plate 11. The locking nose 13 is recessed as at **13*a* to define therein a retaining recess opening downwardly for releasably receiving therein a portion of the cover plate 12. The base plate 11 further includes a presser projection 15 disposed centrally between the locking nose 13 and the shafts 14 and extending parallel to the shafts 14. The presser projection 15 cooperates with a portion of the cover plate 12 in firmly holding a belt B therebetween against displacement, as described later on. The presser projection 15 has a locking protuberance 15*a* swelled toward the locking nose 13**.

The base plate 11 also includes four attachment posts or columns 16 projecting perpendicularly from the underside of the base plate 11 for attaching the strap fastener 10 to the body C of a bag. The attachment posts 16 have a substantially square cross-sectional shape (FIG. 4) and are located near four corners of the rectangular base plate 11, respectively. Each of the attachment posts 16 has a series of saw-teeth or serrations 17 on two adjacent side walls thereof and a guide ridge 18 on one of the remaining side walls. Though not designated, each saw tooth 17 includes a vertical surface facing toward the base plate 11 and a sloping surface facing away from the base plate 11. The attachment posts 16 are driven through corresponding openings formed in the bag body C and then are held on a retainer plate 30, thereby mounting the strap fastener 10 on the bag. As an alternative, the attachment posts 16 may be fused to the retainer plate 30.

The base plate 11 further has an elongate opening **11*a* extending along the locking nose 13, and a pair of grooves 11*b*, 11*b* disposed on opposite side of the locking nose 13 and opening at one end to the elongate opening 11*a*. With the opening 11*a* and the grooves 11*b* thus provided, the upper end portion of the base plate 11 posesses a certain degree of resiliency so that the locking nose 13 is tiltable about its distal end upwardly away from the presser projection 15. To cause this tilting movement, a suitable tool such as a screwdriver D is angularly moved or tilted in the direction indicated by the arrow A in FIG. 7 while a tip of the screwdriver D is received in a groove 19 defined in a flap or wing 19*a* which projects upwardly outwardly from the locking nose 13. The grooves 11*b* may be omitted in which instance the locking nose 13 is tiltable about the upper edge of the base plate 11** and hence the screw driver D is tilted in a direction opposite to the direction of the arrow A.

The cover plate 12 is of a generally rectangular shape and has three parallel spaced transverse slots 20, 21, 22 for the passage therethrough of the belt B. The intermediate slot 21 has a width large enough to concurrently receive the presser projection 15 and the portion of the belt B. The lower end of the cover plate 12 is centrally recessed as at 23 so as to leave a pair of parallel spaced support flanges 24, 24 on opposite sides of the recess 23. The support flanges 24, 24 have a pair of coaxial holes 25, 25, respectively, in which the shafts 14 of the base plate 11 are rotatably received. The shafts 14 and the support flanges 24 constitute a hinge joint by means of which the cover plate 12 is pivotably movable with respect to the base plate 11. The intermediate slot 21 and the upper slot 22 are separated by a cross bar 26. The cross bar 26 has a longitudinal locking ridge **26*a* extending along its rear edge and projecting into the intermediate slot 21. With this construction, when the cover plate 12 is locked on the base plate 11, the locking proturberance 15*a* is snapped with the locking ridge 26*a* with the presser projection 15 lying close to the cross bar 26. Thus, a portion of the belt B extending around the cross bar 26 is gripped by and between the cross bar 26 and the presser projection 15. In this instance, the locking protuberance 15*a* and the locking ridge 26*a* bite into the belt B to firmly retain the same against displacement. The cover plate 12 further has an L-shaped locking projection 27 extending transversely along the upper edge of the cover plate 12. The locking projection 27 is receivable in the retaining recess 13*a* and lockingly engageable with the locking nose 13 to lock the cover plate 12 on the base plate 11**.

Figure 5:
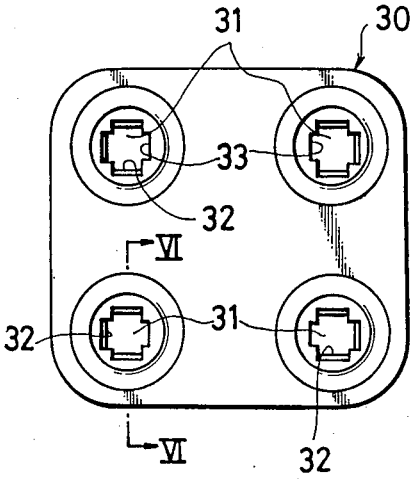
FIG. 5 is a front elevational view of a retainer plate used for the attachment of the strap fastener to a bag.
Figure 6:
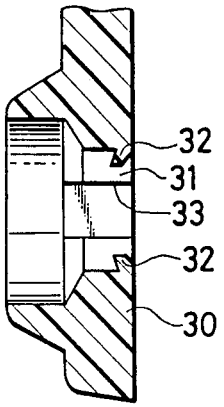
FIG. 6 is a cross-sectional view taken along line VI—VI of FIG. 5.

As shown in FIGS. 5 and 6, the retainer plate 30 is molded of synthetic resin and has four openings or holes 31 for receiving therein the corresponding attachment posts 16 on the base plate 11, each of the openings 31 having four adjoining axial grooves. The retainer plate 30 further includes three locking pawls 32 projecting into each of the holes 31 and lockingly engageable with the saw-teeth 17 on one attachment post 16 to couple the base plate 11 with the retainer plate 30. The locking pawls 32 are disposed adjacent to one end of the hole 31 and incline toward the other end. One of the axial grooves is flat throughout the length thereof and is free of the locking pawl 32. This axial groove 32 serves as a guideway for guidingly receiving therein the guide ridge 18 on each attachment post 16.

Figure 7:
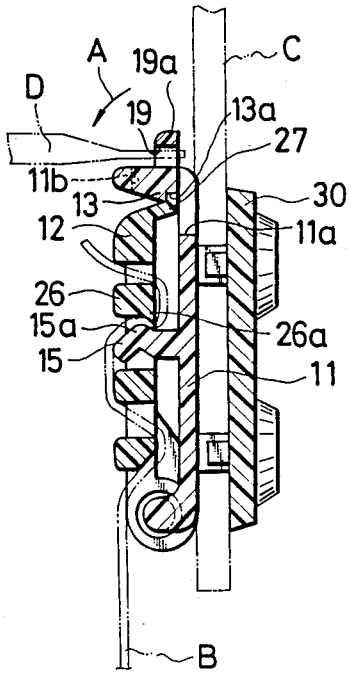
FIG. 7 is a view similar to FIG. 1, showing the manner in which the end of a strap or belt is released from the strap fastener.
Figure 8:
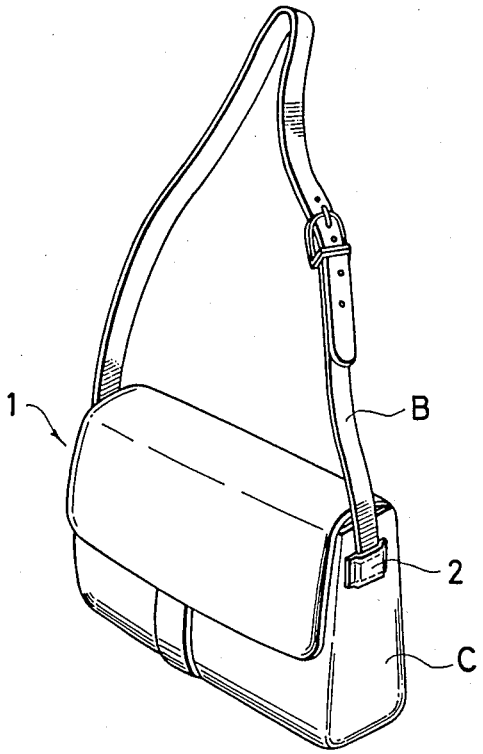
FIG. 8 PRIOR ART
FIG. 8 is a perspective view of a shoulder bag, illustrative of a conventional mode of attachment of a belt to the bag body.

To attach the strap fastener 10 of the foregoing construction to the body C of a bag, the attachment posts 16 are driven through the fabric of the bag body C (FIG. 1) and then through the holes 31 in the retainer plate 30 (FIG. 7). In this instance, the guide ridges 18 on the attachment posts 16 are guidingly received in the guide grooves 33 in the respective holes 31. Insertion of the attachment posts 16 into the holes 31 is effected stepwise but smoothly because the saw-teeth 17 on the attachment posts 16, slope in a direction of movement of the attachment posts 16 which is the same as the direction of inclination of the locking pawls 32. When the attachment posts 16 are inserted into the holes 31 until the fabric of the bag body C is sandwiched between the base plate 11 and the retainer plate 30, the saw-teeth 17 catch and hold the locking pawls 32, which prevent backward movement. Now the base plate 11 of the strap fastener 10 is fixedly mounted on the bag body C.

Then one end of a belt B is looped on the cover plate in such a manner that the belt end passes successively through the transverse slots 20–21 in a meandering or zig-zag formation while looping aound the interior side of the cross bar 26, as shown in FIG. 1. Thereafter, the cover plate 12 is turned about the shafts 14 toward the base plate 11. This angular movement of the cover plate 12 causes the locking projection 27 to engage and then slide down the locking nose 13. In response to sliding movement of the locking projection 27, the upper end portion of the base plate 11 is resiliently deformed to allow the locking nose 13 to tilt outwardly. A further angular movement of the cover plate 12 causes the locking projection 27 to move past the locking nose 13 whereupon the locking projection 27 is snapped into the retaining recess **13*a* where the locking projection 27 is held in interlocking engagement with the locking nose 13. Substantially at the same time, the locking protuberance 15*a* is snapped over the belt portion extending around the locking ridge 26*a*. Now the cover plate 12 is locked on the base plate, as shown in FIG. 7. In this instance, the presser projection 15 is received in the transverse slot 21 and presses the belt end against the cross bar 26. The locking protuberance 15*a* and the locking ridge 26*a*** bit into the belt B, thereby retainig the belt end against removal.

To open the strap fastener 10, the tip of a screwdriver D is received in the slot 19 in the flap **19*a* and then the screwdriver D is tilted in the direction of the arrow A (FIG. 7). In response thereto, the locking nose 13 is tilted upwardly and outwardly, due to the resilient deformation of the upper end portion of the base plate 11, until the locking projection 27 is released from the locking engagement from the locking nose 13. Thus the cover plate 12 is unlocked from the base plate 11**.

As the belt end is looped around the interior side of the cross bar 26, it is possible to adjust the effective length of the belt B when the cover plate 12 is kept in unlocked condition. If the belt-length adjustment is not necessary, the upper and lower transverse slots 20, 22 may be omitted, in which instance, the belt B is frictionally gripped by and between the presser projection 15 and a side wall of the cover plate 12 defining a single transverse slot through which the belt end is inserted in the strap fastener.

Obviously, many modifications and variations of the present invention are possible in the light of the above teachings. It is therefore to be understood that within the scope of the appended claims, the invention may be practiced otherwise than as specifically described.

What is claimed is:

1. A strap fastener for connecting a belt to the body of a bag, comprising:

(a) a base plate adapted to be mounted on the body of the bag, said base plate including a locking nose at one of its opposite ends, and a presser projection intermediately between said opposite ends; and (b) a cover plate pivotably connected at one of its opposite ends to the other end of said base plate, said cover plate having at the other end thereof a locking projection releasably engageable with said locking nose to interlock said cover plate and said base plate, and at least one slot for the passage therethrough of the belt and receptive of said presser projection, when said cover plate is locked on said base plate, said presser projection being received in said slot and urging the belt against a portion of said cover plate defining said slot to grip the belt therebetween.

2. A strap fastener according to claim 1, said locking nose having a retaining recess opening toward said presser projection, said locking projection being releasably receivable in said retaining recess.

3. A strap fastener according to claim 1, said presser projection including a locking protuberance swelling toward said locking nose, said slot-defining portion of said cover plate having a locking ridge projecting into said slot and snappingly engageable with said locking protuberance.

4. A strap fastener according to claim 1, said base plate further including an opening extending along said locking nose, said one end of said base plate being resiliently deformable to allow said locking nose to tilt toward and away from said presser projection.

5. A strap fastener according to claim 4, said base plate further having a wing projecting outwardly from said locking nose in a direction away from said presser projection and having a groove for receiving therein a tool to flex said one end of said base plate when said cover plate is to be unlocked from said base plate.

6. A strap fastener according to claim 4, said base plate further having a pair of grooves disposed on opposite sides of said locking nose and opening at one end to said opening, said one end of said base plate being resiliently deformable to allow said locking nose to tilt away from said presser projection.

7. A strap fastener according to claim 6, said base plate further having a wing projecting from said locking nose away from said presser projection.

8. A strap fastener according to claim 7, said wing having a groove defined therein.

9. A strap fastener according to claim 1, said cover plate including a further slot extending parallel to the first-mentioned slot for the passage of the belt, and a cross bar extending between said two slots, said portion against which the belt is urged by said presser projection being defined on said cross bar.

10. A strap fastener according to claim 9, said presser projection including a locking protuberance swelling toward said locking nose, said cross bar having a locking ridge projecting into said slot and snappingly engageable with said locking protuberance.

11. A strap fastener according to claim 1, said base plate having a pair of coaxial shafts projecting laterally from said other end of said base plate, said cover plate having a pair of parallel spaced flanges and a pair of holes defined respectively in said flanges, said shafts being rotatably received in said holes.

12. A strap fastener according to claim 1, said base plate and said cover plate being injection-molded of synthetic resin in assembled condition.

13. A strap fastener for connecting a belt to the body of a bag, comprising:

(a) a base plate adapted to be mounted on the body of the bag, said base plate including a locking nose at one of its opposite ends, and a presser projection intermediately between said opposite ends;

(b) a cover plate pivotably connected at one of its opposite ends to the other end of said base plate, said cover plate having at the other end thereof a locking projection releasably engageable with said locking nose to interlock said cover plate and said base plate, and at least one slot for the passage therethrough of the belt and receptive of said presser projection, when said cover plate is locked in said base plate, said presser projection being received in said slot and urging the belt against a portion of said cover plate defining said slot to grip the belt therebetween; and (c) a retainer plate adapted to be disposed on the bag body behind said base plate to sandwich the fabric of the bag body therebetween, said retainer plate having a plurality of holes defined therein, said base plate having a plurality of attachment posts extending perpendicularly from an underside of said plate for being driven through the fabric of the bag body, said attachment posts being lockingly receivable in said holes in said retainer plate.

14. A strap fastener according to claim 13, each said attachment post having a series of saw-teeth, each said hole having a locking pawl lockingly engagable with said saw-teeth.

15. A strap fastener according to claim 13, said attachment post further including a guide ridge, said hole further having a guide groove for guidingly receiving therein said guide ridge.

* * * * *